US009526354B2

(12) United States Patent
Barreto et al.

(10) Patent No.: US 9,526,354 B2
(45) Date of Patent: Dec. 27, 2016

(54) AIR DISTRIBUTION SYSTEM FOR TEMPERATURE-CONTROLLED CASE

(75) Inventors: Angel A. Barreto, Petersburg, VA (US); Jules G. Choueifati, Chester, VA (US); Larry C. Howington, Chesterfield, VA (US)

(73) Assignee: Hill Phoenix, Inc., Conyers, GA (US)

( * ) Notice: Subject to any disclaimer, the term of this patent is extended or adjusted under 35 U.S.C. 154(b) by 1580 days.

(21) Appl. No.: 12/480,510

(22) Filed: Jun. 8, 2009

(65) Prior Publication Data

US 2010/0058789 A1 Mar. 11, 2010

Related U.S. Application Data

(60) Provisional application No. 61/191,825, filed on Sep. 11, 2008.

(51) Int. Cl.
*A47F 3/04* (2006.01)
*F24F 11/00* (2006.01)

(52) U.S. Cl.
CPC ..... *A47F 3/0443* (2013.01); *A47F 3/0439* (2013.01); *A47F 2003/046* (2013.01); *F24F 11/0001* (2013.01)

(58) Field of Classification Search
CPC A47F 3/0439; A47F 3/0443; A47F 2003/046; F24F 11/0002
USPC ..... 62/251, 255, 256; 454/56–62, 193
See application file for complete search history.

(56) References Cited

U.S. PATENT DOCUMENTS 3,115,019 A * 12/1963 Rutishauser ..... 62/256
3,119,241 A 1/1964 Wile
3,130,559 A 4/1964 Beckwith
3,256,799 A 6/1966 Beckwith
3,270,655 A 9/1966 Guirl et al.
3,304,736 A 2/1967 Brennan et al.
3,365,907 A * 1/1968 Barroero ..... 62/256
3,365,908 A 1/1968 Macmaster
3,403,525 A 10/1968 Beckwith et al.
(Continued)

FOREIGN PATENT DOCUMENTS

EP 0334678 A1 9/1989
EP 0768501 A2 4/1997
(Continued)

OTHER PUBLICATIONS

U.S. Appl. No. 12/506,984, filed Jul. 21, 2009, Swofford et al.
(Continued)

*Primary Examiner* — Ryan J Walters
*Assistant Examiner* — Alexis Cox
(74) *Attorney, Agent, or Firm* — Foley & Lardner LLP

(57) ABSTRACT

A temperature-controlled case including a base having a deck and an air flow device located below the deck, a tower having a cavity, and an air distribution system. The air distribution system includes a duct and one or more air diverting devices which permit a first portion of an air flow to be received into the tower and direct a second portion of the air flow toward the deck. Sub-portions of the first portion may be directed at the rear portions and front portions of one or more shelves. The tower includes an exterior wall having openings through which air is directed by the air diverting devices. The exterior wall may be faceted and the cavity may be segmented into channels corresponding to the facets.

22 Claims, 9 Drawing Sheets

(56) References Cited

U.S. PATENT DOCUMENTS

| | | | | |
|---|---|---|---|---|
| 3,584,467 | A * | 6/1971 | Barroero | 62/252 |
| 3,771,323 | A | 11/1973 | Simons et al. | |
| 3,937,033 | A | 2/1976 | Beckwith et al. | |
| 4,124,996 | A | 11/1978 | Kennedy et al. | |
| 4,144,720 | A | 3/1979 | Subera et al. | |
| 4,148,197 | A | 4/1979 | Karashima | |
| 4,269,037 | A | 5/1981 | Karashima | |
| 4,299,099 | A | 11/1981 | Myers et al. | |
| 4,314,458 | A * | 2/1982 | Hade et al. | 62/256 |
| 4,326,385 | A | 4/1982 | Ibrahim | |
| 4,414,822 | A | 11/1983 | Ibrahim | |
| 4,514,988 | A | 5/1985 | Ibrahim | |
| 4,648,247 | A | 3/1987 | Takizawa et al. | |
| 4,741,171 | A | 5/1988 | Toshiyuki | |
| 4,750,335 | A | 6/1988 | Wallace et al. | |
| 4,760,708 | A | 8/1988 | Karashima | |
| 4,765,150 | A | 8/1988 | Persem | |
| 4,777,806 | A * | 10/1988 | Perez | 62/256 |
| 4,938,034 | A | 7/1990 | Rosanio et al. | |
| 4,964,281 | A | 10/1990 | Tanaka | |
| RE33,620 | E | 6/1991 | Persem | |
| 5,048,303 | A | 9/1991 | Campbell et al. | |
| 5,138,843 | A | 8/1992 | Tamayama et al. | |
| 5,228,581 | A | 7/1993 | Palladino et al. | |
| 5,357,767 | A | 10/1994 | Roberts | |
| 5,475,987 | A | 12/1995 | McGovern | |
| 5,475,988 | A | 12/1995 | McGovern | |
| 5,606,863 | A | 3/1997 | Kicklighter et al. | |
| 5,644,831 | A | 7/1997 | Federico | |
| 5,675,983 | A | 10/1997 | Ibrahim | |
| 5,755,108 | A | 5/1998 | Ibrahim et al. | |
| 5,924,297 | A | 7/1999 | Wolff et al. | |
| 6,094,925 | A | 8/2000 | Arshansky et al. | |
| 6,151,904 | A | 11/2000 | Jin | |
| 6,170,270 | B1 | 1/2001 | Arshansky et al. | |
| 6,185,951 | B1 | 2/2001 | Lane et al. | |
| 6,360,548 | B1 | 3/2002 | Navarro | |
| 6,381,976 | B1 | 5/2002 | Kempiak et al. | |
| 6,405,548 | B1 | 6/2002 | Hollenbeck | |
| 6,431,060 | B1 | 8/2002 | Gutheim | |
| 6,519,962 | B1 | 2/2003 | Schuetter | |
| 6,539,741 | B2 | 4/2003 | Navarro | |
| 6,694,757 | B1 | 2/2004 | Backman | |
| 6,708,511 | B2 | 3/2004 | Martin | |
| 6,722,149 | B1 | 4/2004 | Saroka et al. | |
| 6,742,344 | B2 | 6/2004 | Vormedal | |
| 6,745,588 | B2 | 6/2004 | Kahler | |
| 6,827,463 | B2 | 12/2004 | Chuang et al. | |
| 6,851,271 | B2 | 2/2005 | Upton et al. | |
| 6,883,343 | B2 | 4/2005 | Lane et al. | |
| 6,889,514 | B2 | 5/2005 | Lane et al. | |
| 6,889,518 | B2 | 5/2005 | Lane et al. | |
| 6,912,864 | B2 | 7/2005 | Roche et al. | |
| 6,915,652 | B2 | 7/2005 | Lane et al. | |
| 6,955,061 | B2 | 10/2005 | Chiang et al. | |
| 6,959,560 | B2 | 11/2005 | Weikel et al. | |
| 6,981,385 | B2 | 1/2006 | Arshansky et al. | |
| 6,993,925 | B2 | 2/2006 | Duffy | |
| 7,010,924 | B2 | 3/2006 | Kempiak | |
| 7,036,947 | B2 | 5/2006 | Chuang et al. | |
| 7,065,979 | B2 | 6/2006 | Arshansky et al. | |
| 7,121,104 | B2 | 10/2006 | Howington et al. | |
| 7,137,438 | B2 * | 11/2006 | Nomura et al. | 165/64 |
| 7,159,413 | B2 | 1/2007 | Dail | |
| 7,216,500 | B2 | 5/2007 | Schwichtenberg et al. | |
| 7,275,376 | B2 | 10/2007 | Swofford et al. | |
| 7,357,000 | B2 | 4/2008 | Schwichtenberg et al. | |
| 7,497,770 | B2 | 3/2009 | Grassmuck et al. | |
| 2001/0042383 | A1 | 11/2001 | Chiang et al. | |
| 2001/0042384 | A1 | 11/2001 | Chiang et al. | |
| 2002/0162346 | A1 | 11/2002 | Chiang et al. | |
| 2002/0184904 | A1 | 12/2002 | Wellman | |
| 2003/0159451 | A1 | 8/2003 | Nash, Jr. | |
| 2004/0055321 | A1 | 3/2004 | Kempiak | |
| 2004/0244396 | A1 | 12/2004 | Lane et al. | |
| 2005/0039483 | A1 | 2/2005 | Yun et al. | |
| 2005/0076662 | A1 | 4/2005 | Roche et al. | |
| 2005/0126196 | A1 | 6/2005 | Grassmuck et al. | |
| 2005/0132744 | A1 | 6/2005 | Rohrer et al. | |
| 2005/0138943 | A1 | 6/2005 | Alahyari et al. | |
| 2005/0144966 | A1 | 7/2005 | Upton et al. | |
| 2005/0150241 | A1 | 7/2005 | Upton et al. | |
| 2005/0193755 | A1 | 9/2005 | Duffy | |
| 2006/0042288 | A1 | 3/2006 | Downs | |
| 2006/0242980 | A1 | 11/2006 | Duffy et al. | |
| 2007/0006604 | A1 | 1/2007 | Behr | |
| 2007/0012059 | A1 | 1/2007 | Roche et al. | |
| 2007/0289323 | A1 | 12/2007 | Swofford et al. | |
| 2008/0271473 | A1 | 11/2008 | Fung et al. | |
| 2008/0282719 | A1 | 11/2008 | Fung | |
| 2009/0044553 | A1 | 2/2009 | Tilley | |
| 2009/0084125 | A1 | 4/2009 | Fung | |
| 2009/0205351 | A1 | 8/2009 | Fung | |
| 2009/0215381 | A1 | 8/2009 | Swofford | |
| 2009/0223237 | A1 | 9/2009 | Grassmuck et al. | |
| 2010/0212343 | A1 | 8/2010 | Swofford et al. | |

FOREIGN PATENT DOCUMENTS

| | | | |
|---|---|---|---|
| FR | 1324962 | A | 4/1963 |
| GB | 1172217 | A | 11/1969 |
| WO | WO-2005/058101 | A1 | 6/2005 |
| WO | WO-2006/115824 | A2 | 11/2006 |
| WO | WO-2008/051226 | A1 | 5/2008 |

OTHER PUBLICATIONS

International Search Report for International Application No. PCT/US2005/44177, mailed Apr. 7, 2006, 1 page.

International Search Report for International Application No. PCT/US2006/014038; mailed Nov. 27, 2006; 1 page.

Written Opinion of the International Search Authority for International Application No. PCT/US2005/44177, completed Mar. 20, 2006, 3 pages.

Office Action for Canadian Application No. 2,671,568, mail date Apr. 29, 2015, 4 pages.

* cited by examiner

AIR DISTRIBUTION SYSTEM FOR TEMPERATURE-CONTROLLED CASE

CROSS-REFERENCE TO RELATED PATENT APPLICATIONS

This application claims priority from U.S. Provisional Application No. 61/191,825, titled "Refrigerated Display Case" and filed Sep. 11, 2008, incorporated herein by reference in its entirety.

BACKGROUND

It is well known to provide a temperature controlled display case such as a refrigerator, freezer, refrigerated merchandiser, refrigerated display case, etc., that may be used in commercial, institutional, and residential applications for storing or displaying refrigerated or frozen objects. For example, it is known to provide refrigerated display cases or merchandisers having an air circulation or distribution system for distributing air chilled by a cooling element throughout a display space within the case or merchandiser to maintain products at a desired temperature. However, such known air distribution systems in refrigerated display cases and merchandisers tend to result in uneven air distribution and varying temperatures for the products stored within the case. A temperature-controlled case having an improved air distribution system is provided.

SUMMARY

According to one embodiment, a temperature-controlled case comprises a base including an air flow device configured to provide an air flow, an air distribution tower, and a plurality of shelves each having a front portion and a rear portion. The rear portion of each shelf is disposed adjacent to the air distribution tower. At least one of the plurality of shelves includes a shelf base, a shelf cover, and a space defined therebetween. The shelf cover includes a plurality of openings at the front portion of the at least one shelf. The air flow is directed in a first flow path through the space toward the openings in the front portion of the at least one shelf and directed in a second flow path toward the rear portion of the at least one shelf.

According to another embodiment, a temperature-controlled case comprises a base including an upper surface and an air flow device configured to provide an air flow. The air flow has a first portion and a second portion. The temperature-controlled case further comprises an air distribution tower and a plurality of shelves each having a front portion and a rear portion. The rear portion of each shelf is disposed adjacent to the air distribution tower. The temperature-controlled case further comprises at least one air diverting device. The at least one air diverting device is configured to receive the second portion of the air flow and direct the second portion of the air flow toward the upper surface of the base. The at least one air diverting device also permits the first portion of the air flow to be directed into the air distribution tower.

According to another embodiment, a temperature-controlled case comprises a base, an air flow device configured to provide an air flow, and an air distribution tower including a substantially vertical exterior wall. The exterior wall includes a plurality of planar segments and defines a cavity. The cavity is segmented by at least one interior wall into a plurality of substantially vertical channels. Each of the plurality of channels substantially corresponds to one of the plurality of planar segments of the exterior wall. The temperature-controlled case further comprises a plurality of shelves having a front portion and a rear portion. The rear portion of each shelf is disposed proximate the air distribution tower. A plurality of diffusers are positioned in the air distribution tower. Each of the plurality of diffusers is configured to at least partially define one or more flow paths for the air flow from the plurality of channels toward at least one of the plurality of shelves.

DETAILED DESCRIPTION

Referring to the FIGURES, various embodiments of a temperature-controlled case shown as a refrigerated case 10 are disclosed. According to the embodiments shown, refrigerated case 10 (e.g., merchandiser, etc.) is an "end" portion of an island-type case. Specifically, refrigerated case 10 is shown as an 180 degree end portion configured to be coupled to an end of a "straight" portion of an island-type case. Refrigerated case 10 is further shown as a front-loading, open-front type case (e.g., "reach-in," "self-service," etc.). Accordingly, refrigerated case 10 includes a front 12 that is open and a rear 14 wherein refrigerated case 10 is configured to be coupled to the end of a straight portion of an island-type case at rear 14. Alternatively, rear 14 may be aligned proximate a wall in the space in which the case is located. While the temperature-controlled case is shown as a refrigerated case, the temperature-controlled case may also be a heated case. Further, concepts disclosed herein may be applied to any of a variety of temperature-controlled cases (e.g., a straight portion of an island-style case, an end portion that is a 90 degree end portion, rear-loading cases, etc.).

Figure 1A:
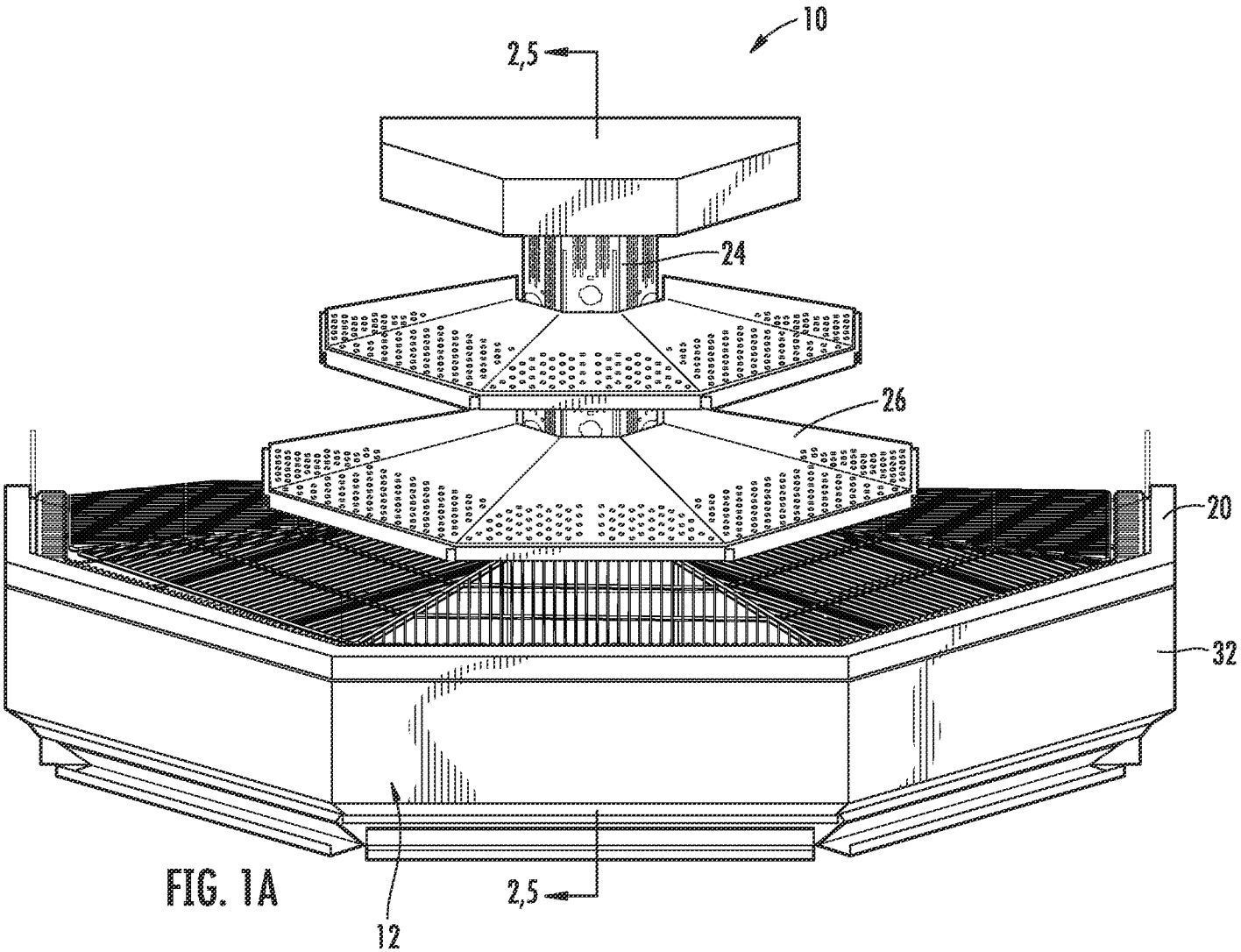
FIG. 1A is a front perspective view of a portion of a temperature-controlled case according to a first exemplary embodiment.
Figure 1B:
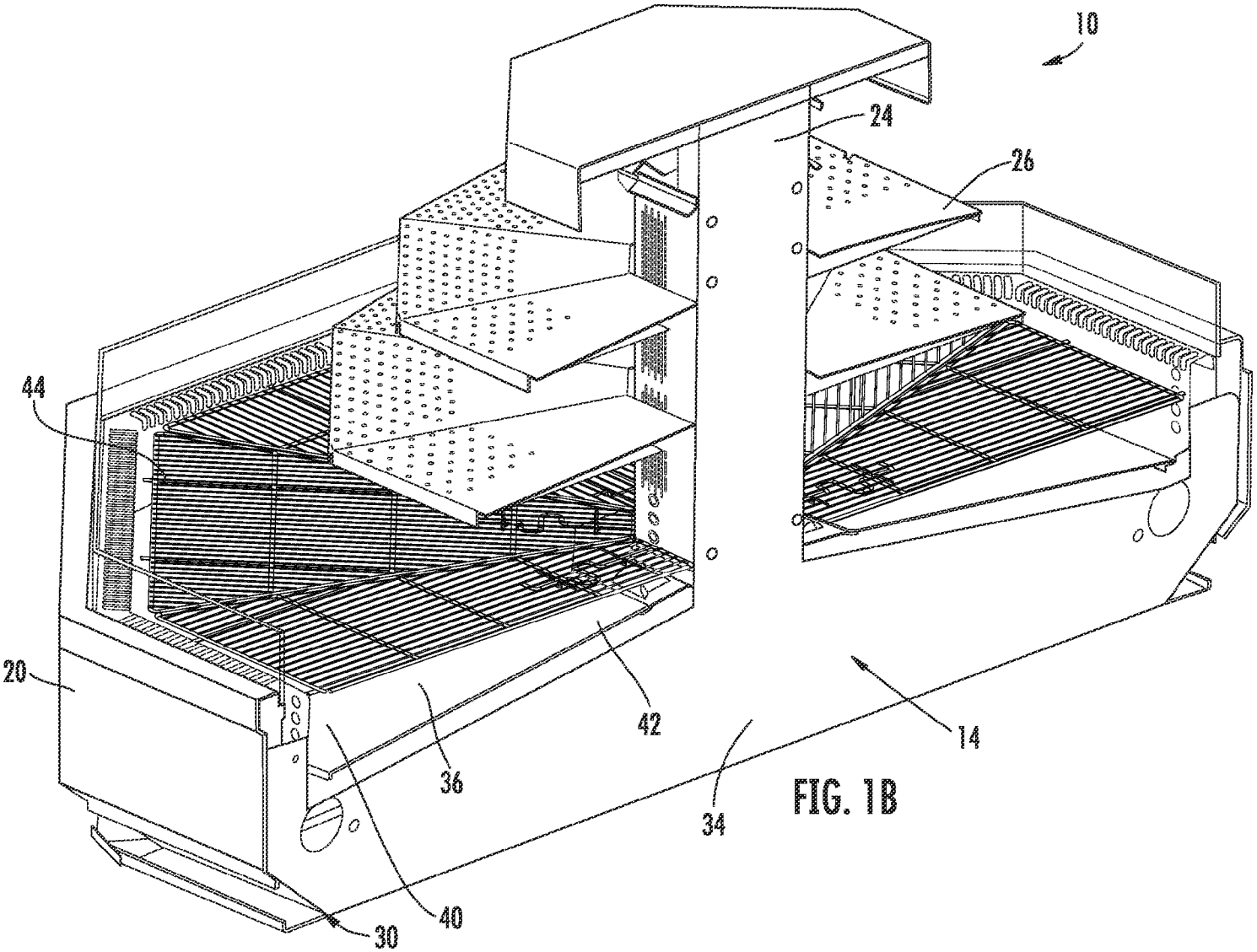
FIG. 1B is a rear perspective view of the exemplary embodiment of a temperature-controlled case of FIG. 1A.
Figure 2:
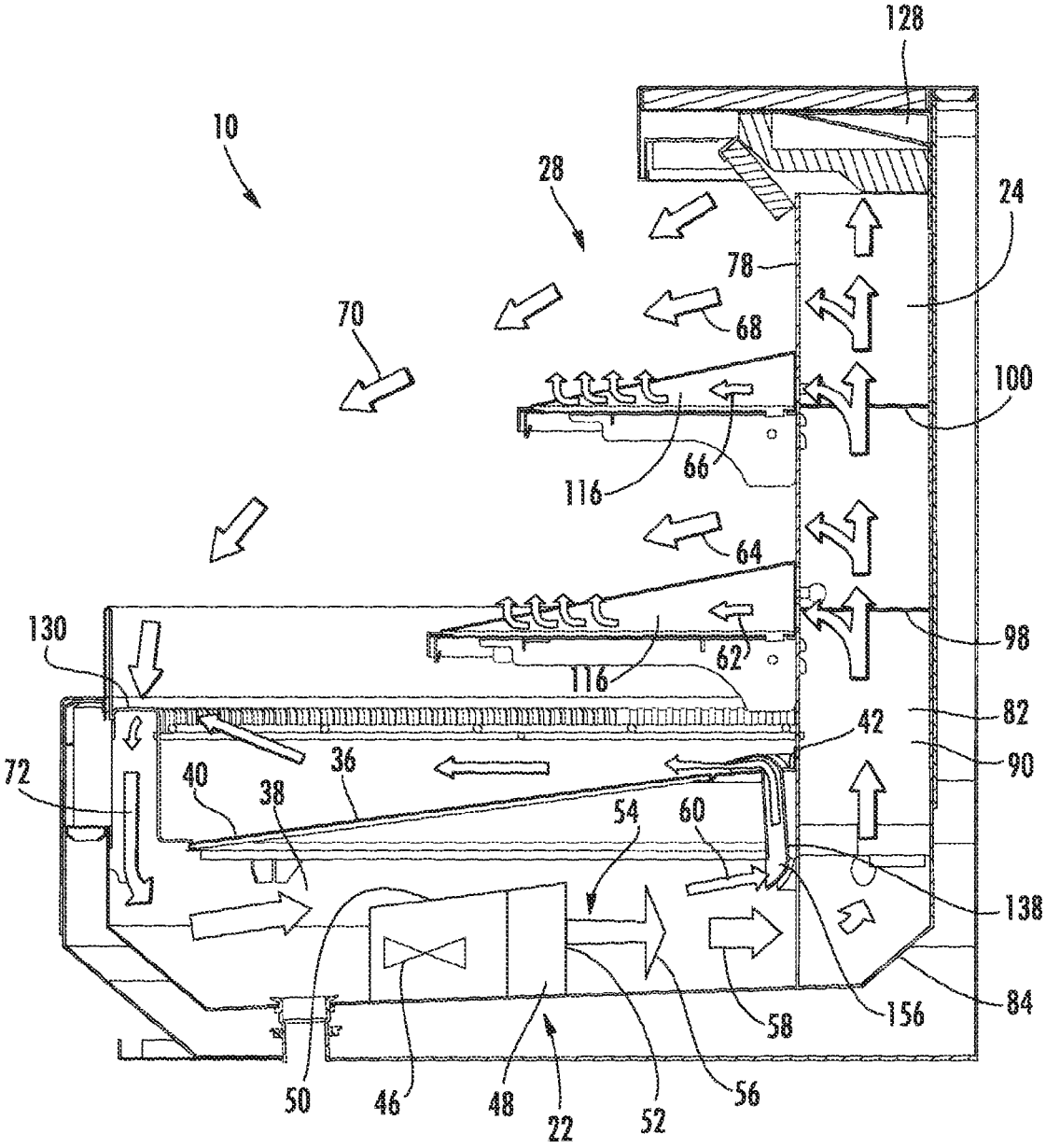
FIG. 2 is a side plan, cross-sectional view of the exemplary embodiment of a temperature-controlled case of FIG. 1A along line 2-2 illustrating the air flow through the temperature-controlled case and the air distribution system.

Referring to FIGS. 1A and 1B, refrigerated case 10 is shown according to an exemplary embodiment including a base 20, a cooling system 22, a tower 24 having a plurality of product support surfaces shown as shelves 26, and an air circulation or air distribution system 28 (see, e.g., FIG. 2 illustrating cooling system 22 and air distribution system 28). Refrigerated case 10 displays and/or stores products (e.g., food products). Refrigerated case 10 is configured to maintain products displayed and/or stored therein at a constant temperature. Air distribution system 28 provides for enhanced air flow and cooling within refrigerated case 10. Further, air distribution system 28 provides for a more balanced cooling profile to maintain products at a more uniform temperature (e.g., products located at various locations within the refrigerated case are maintained at substantially the same temperature, etc.).

Figure 5:
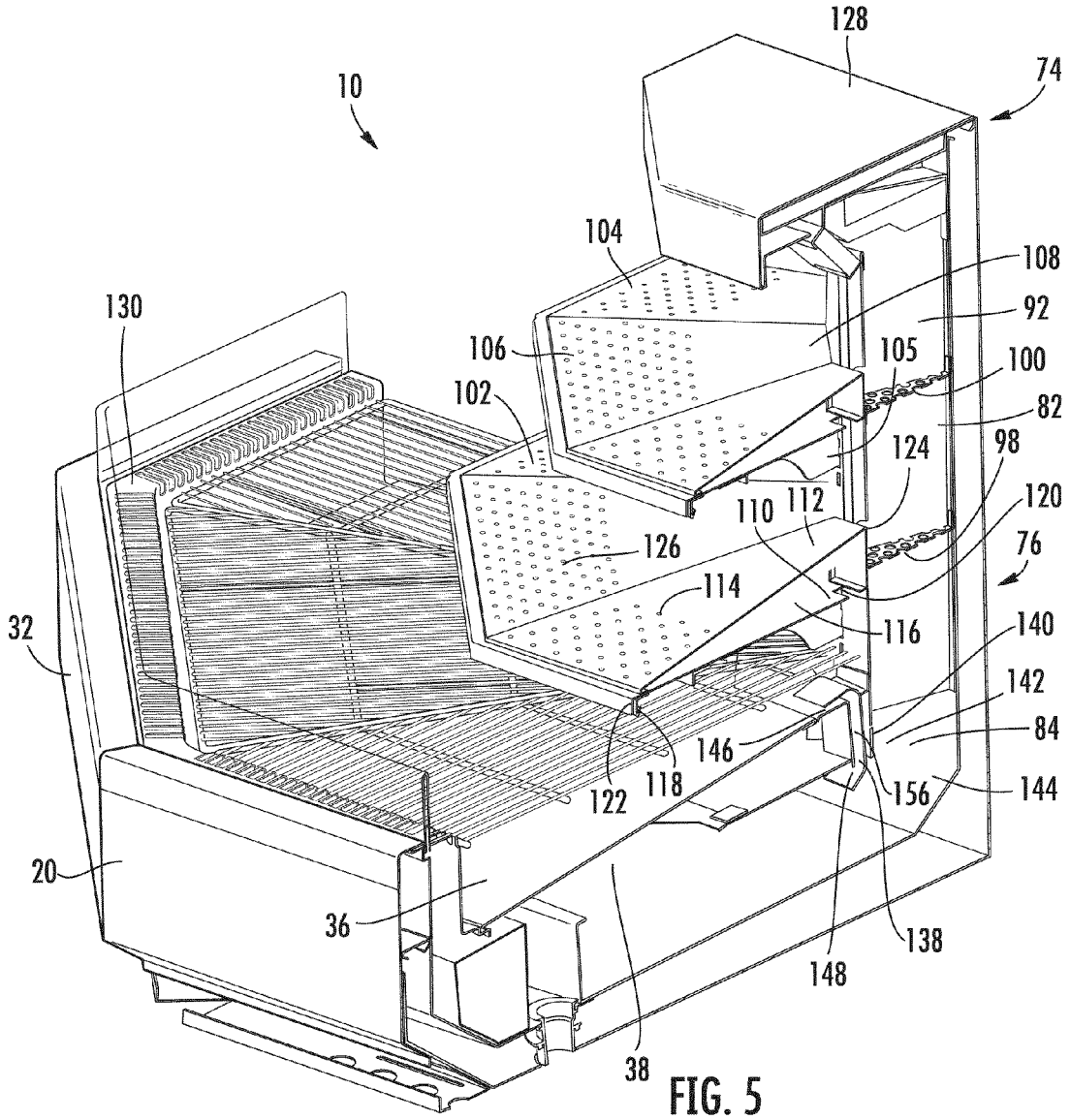
FIG. 5 is a perspective cross-sectional view of the exemplary embodiment of a temperature-controlled case of FIG. 1A along the line 5-5.

Base 20 is shown including a bottom 30, an outer wall 32, a rear wall 34, and an upper surface or deck 36 defining space or cavity shown as cavity 38 therebelow (see, e.g., FIG. 5 illustrating cavity 38). Base 20 provides stability for refrigerated case 10 and in part defines the product display space within refrigerated case 10. Bottom 30 of base 20 is generally placed on or near the ground or floor of a room or space in which refrigerated case 10 is located (e.g., a grocery store, a convenience store, a personal residence, etc.). Rear wall 34 of base 20 substantially corresponds to rear 14 of refrigerated case 10. Outer wall 32 is shown extending substantially about the periphery of refrigerated case 10. The space between tower 24 and outer wall 32 generally defines the product display space within refrigerated case 10. Deck 36 is shown extending substantially between tower 24 and outer wall 32 to provide a product support surface. Deck 36 includes a front portion 40 proximate outer wall 32 and a rear portion 42 proximate tower 24. A grate 44 may be disposed or coupled to refrigerated case 10 above deck 36 to directly support products stored thereon. Grate 44 (e.g., rack, grill, etc.) is shown spaced apart a distance from deck 36 and configured to allow air pass therethrough. In some embodiments, no grate is present. In other embodiments, the deck extends only partially between the tower and the outer wall.

Referring to FIG. 2, cooling system 22 is shown located within base 20 below deck 36 within cavity 38 according to an exemplary embodiment. Cooling system 22 includes an air flow device such as a fan 46 or a plurality of fans, a cooling element such as a cooling coil 48, a control system, an air inlet 50, and an air outlet 52. Cooling system 22 is configured to cool or chill products displayed in refrigerated case 10 and help maintain those products a desired temperature. Cooling system 22 generates an air flow 54 that is chilled and distributed throughout refrigerated case by air distribution system 28. Cooling system 22 circulates a coolant through cooling coil 48. The control system regulates a flow of coolant in response to the temperature measured within refrigerated case 10. Fan 46 draws air into cooling system 22 and directs at least a portion of the air through air inlet 50, over cooling coil 48, and through air outlet 52. The air passing over cooling coil 48 is chilled or cooled. Air flow 54 is then discharged from cooling system 22 through air outlet 52.

Referring further to FIG. 2, air flow 54 is shown according to an exemplary embodiment including a discharge air flow portion 56. Discharge air flow portion 56 includes at least a first air flow portion 58 and a second air flow portion 60. First air flow portion 58 is shown to include a first air flow sub-portion 62, a second air flow sub-portion 64, a third air flow sub-portion 66, and a fourth air flow sub-portion 68. Air flow 54 is further shown including an air curtain 70 and a return air flow portion 72. The various portions and sub-portions of air flow 54 are distributed throughout refrigerated case 10 by air distribution system 28.

Figure 3:
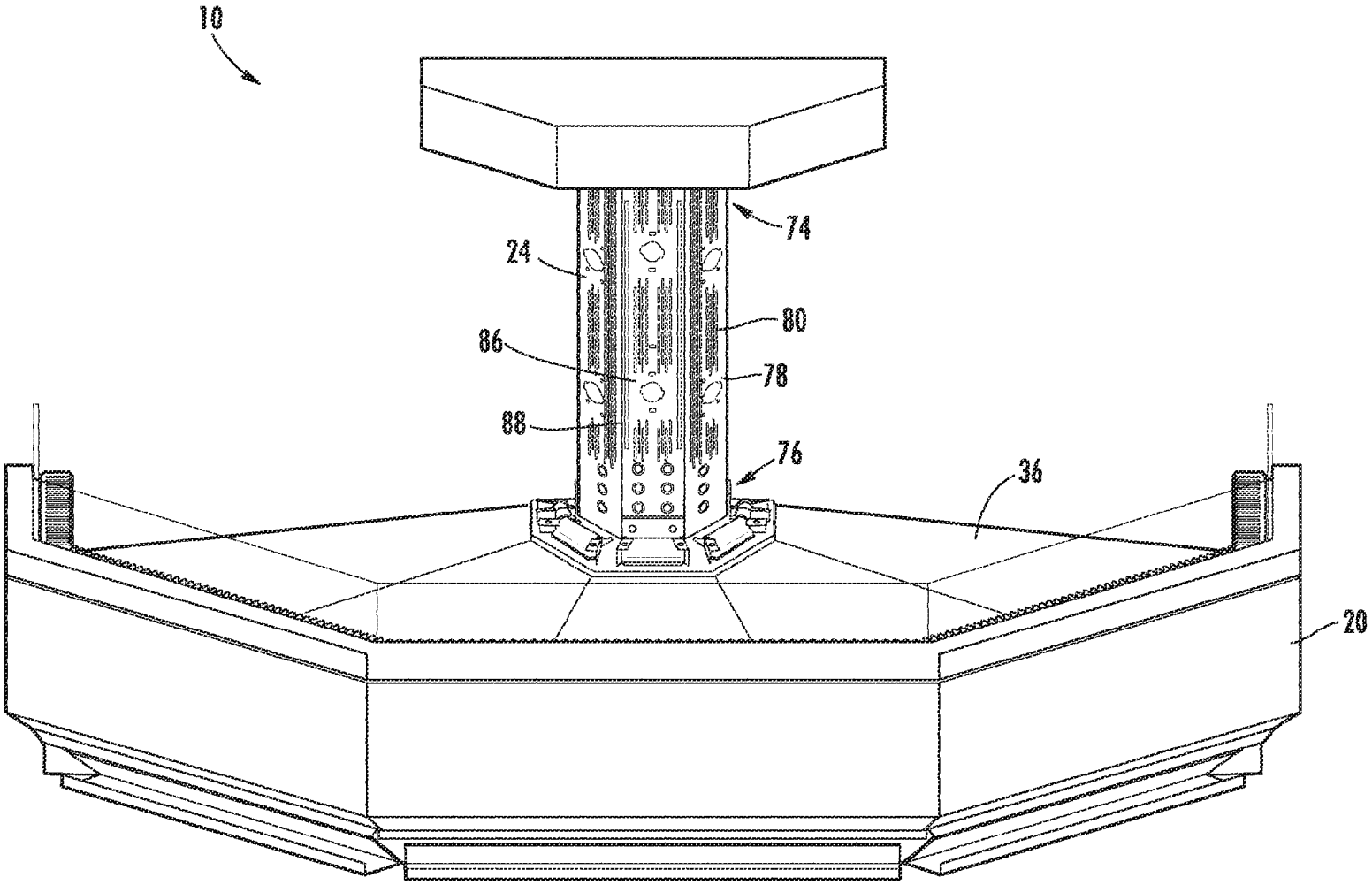
FIG. 3 is a perspective view of the exemplary embodiment of a temperature-controlled case of FIG. 1A with the shelves and the grate removed.
Figure 4:
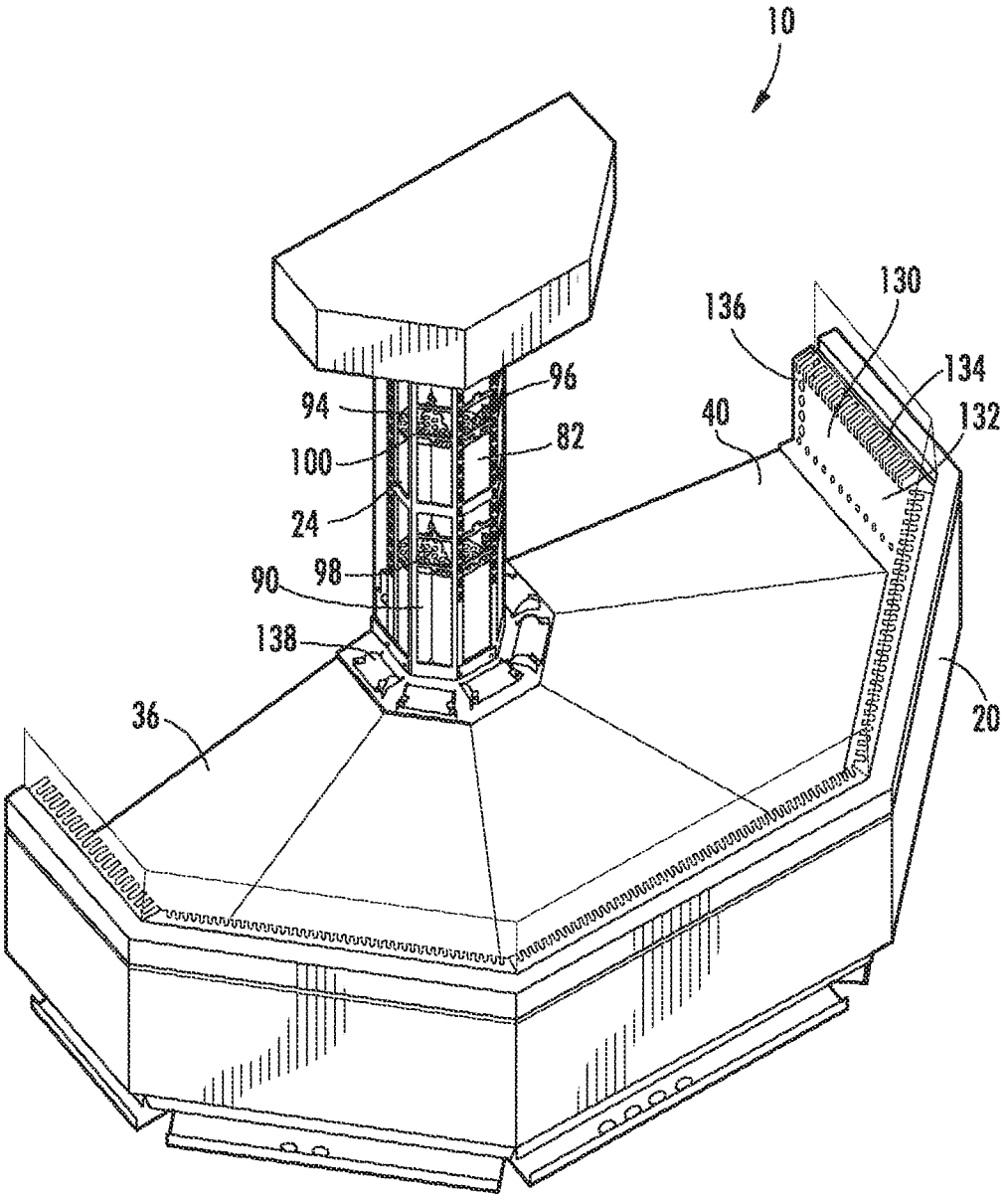
FIG. 4 is a perspective view of the exemplary embodiment of a temperature-controlled case of FIG. 1A with the shelves, the grate, and the exterior wall of the tower removed.

Referring to FIGS. 3 and 4, tower 24 is shown according to an exemplary embodiment including a top 74, a bottom 76, an exterior wall 78 having a plurality of openings 80, and a cavity 82. Tower 24 is configured to diffuse or distribute first air flow portion 58 within refrigerated case 10. Tower 24 is shown to extend substantially vertically upward from base 20. Exterior wall 78 of tower 24 is shown substantially vertical and substantially defining cavity 82. Cavity 82 is shown to extend substantially vertically upward. Cavity 82 is configured to receive first air flow portion 58 from cooling system 22 via a duct 84, which is discussed in more detail below. Openings 80 (e.g., slots, apertures, holes, slits, spaces, etc.) in exterior wall 78 of tower 24 provide for thermal communication between cavity 82 and the product display space of refrigerated case 10. Openings 80 are shown substantially elongated and in groups extending generally between top 74 and bottom 76 of tower 24. Openings generally correspond to the locations at which shelves 26 are disposed relative to the tower. First air flow portion 58 is distributed (e.g., diffused, directed, discharged, etc.) from within cavity 82 through openings 80 in order to cool products in the product space and to help maintain the products at a uniform, desired temperature. Openings 80 are generally shaped, sized, and/or arranged in a pattern intended to achieve a desired distribution of the air flow. The openings may vary in size, shape, pattern, and arrangement (e.g., the openings may include large round openings and/or a series of openings forming a honeycomb patterns, etc.).

Referring to FIG. 3, tower 24 is shown as a faceted tower having a generally geometric/polygonal shape according to an exemplary embodiment. Exterior wall 78 includes a plurality of segments shown as substantially planar segments 86 (e.g., facets, etc.) that extend substantially vertically upward from base 20 and meet at (e.g., are coupled at, coincide at, are defined by, etc.) a plurality of edges or corners 88. According to other embodiments, the planar segments and/or the corners may be disposed at a range of angles relative to the base.

In some embodiments, outer wall 32 of base 20 is configured to correspond to the faceted tower. As shown in FIG. 3, outer wall 32 includes a plurality of segments that are generally parallel to planar segments 86 of tower 24. According to other exemplary embodiments, the exterior wall of the tower and/or the outer wall of the base may include a plurality of segments that are curved or may be unsegmented.

Referring to FIG. 4, cavity 82 is shown according to an exemplary embodiment segmented into a plurality of channels 90 by interior walls 92. Channels 90 and interior walls are shown extending substantially vertically upward from bottom 76 to top 74 of tower 24. In one embodiment, cavity 82 is segmented to correspond to the facets of tower 24. As shown in FIG. 3, each channel 90 of cavity 82 substantially corresponds to a planar segment 86 of exterior wall 78, and interior walls 92 are generally aligned with corners 88. The air received in each channel 90 is distributed through openings 80 in the planar segment 86 corresponding to that channel.

Referring further to FIG. 4, a plurality of diffusers 94 are shown substantially planar, including a plurality of diffuser holes 96, and disposed or positioned within cavity 82 of tower 24. Each diffuser 94 is configured to direct one or more sub-portions of first air flow portion 58 received in channels 90 of cavity 82 through openings 80 and to allow the remaining first air flow portion 58 to continue upward through cavity 82 and/or into a canopy 128 via diffuser holes 96. Diffusers 94 and canopy 128 provide a progressive series of flow restrictions, slowing or decreasing the velocity of first air flow portion 58 in cavity 82 and facilitating the discharge of sub-portions of first air flow portion 58 through openings 80. As first air flow portion 58 encounters a diffuser, the surface of the diffuser slows the air flow and directs one or more air flow sub-portions through openings 80 of exterior wall 78, generally toward shelves 26. Other air flow sub-portions continue to flow upward in cavity 82, passing through diffuser holes 96. Diffusers 94 and canopy 128 create back pressure that helps direct or force additional air flow sub-portions (e.g., those that have flowed through diffuser holes 96) through openings 80 of exterior wall 78. Diffuser holes 96 (e.g., apertures, openings, slits, slots, spaces, etc.) are sized, shaped, and/or arranged in a pattern intended to achieve a desired distribution of air flow and/or to maintain a desired air flow velocity within cavity 82. Diffuser holes 96 may vary in size, shape, pattern, and/or arrangement (e.g., the holes may include staggered round holes and/or a series of linear openings, etc.).

Referring to FIG. 4, the plurality of diffusers 94 is shown including a first diffuser 98 and a second diffuser 100. First diffuser 98 and second diffuser 100 are disposed so to substantially correspond to the position of a first shelf 102 and a second shelf 104. First diffuser 98 is configured to direct one or more sub-portions of first air flow portion 58 toward first shelf 102 or a segment thereof. Second diffuser 100 is configured to direct one or more sub-portions of first air flow portion 58 toward second shelf 104 or a segment thereof. Back pressure created by first diffuser 98 and second diffuser 100 may also cause one or more sub-portions of first air flow portion 58 to discharge (e.g., a sub-portion that has passed through the first diffuser us discharged at openings in the exterior wall thereabove).

Referring to FIG. 5, shelves 26 are illustrated according to an exemplary embodiment providing for multi-tiered product display, which includes first shelf 102 and second shelf 104. Shelves 26 are configured to support products displayed and/or stored within refrigerated case 10. First shelf 102 is shown proximate deck 36. Second shelf 104 shown above first shelf 102 and distal to or a greater distance from deck 36 than first shelf 102. Any of a variety of products may be placed on shelves 26, where the products are supported, cooled, and accessible. Although, shelves 26 are shown cantilevered and supported by a plurality of brackets 105, the shelves may be supported in any manner such that the rear portion of each shelf is disposed adjacent or proximate to the tower.

Each shelf 26 includes a front portion 106 and a rear portion 108, wherein rear portion 108 of each shelf 26 is disposed adjacent or proximate to tower 24. Products supported on shelves 26 are cooled by sub-portions of first air flow portion 58 directed there toward diffusers 94. The sub-portions of the first air flow portion 58 are directed toward shelves 26 through openings 80 in tower 24.

Referring further to FIG. 5, shelves 26 are shown according to an exemplary embodiment each including a shelf base 110 and a shelf cover 112 having a plurality of openings 114, and a space 116 defined therebetween. Shelf covers 112 are shown disposed at an angle relative to shelf bases 110 and coupled thereto. Each shelf base 110 includes a front edge 118 and a rear edge 120. Each shelf cover 112 includes a front edge 122 and a rear edge 124. Front edge 122 of each shelf cover 112 is coupled to front edge 118 of the corresponding shelf base 110. Rear edge 124 of each shelf cover 112 is separated a distance from rear edge 120 of the corresponding shelf base 110. Spaces 116 are shown as a wedge shaped spaces defined by the shelf cover and shelf base pairings. Spaces 116 generally extend from the rear edges toward the front edges of each shelf cover and shelf base pairing. Openings 114 are configured to distribute one or more sub-portions of first air flow portion 58 received in spaces 116 through openings 80 in exterior wall 78. Openings 114 are shown as circular holes disposed at a front portion 126 of each shelf cover 112 of shelves 26 and arranged in a pattern. The openings in the shelf covers are sized, shaped, and/or arranged in a pattern intended to achieve a desired distribution of air flow and/or maintain a desired air flow velocity. Openings 114 may vary in size, shape, pattern, and arrangement (e.g., the shelf cover openings may include large circular holes and/or a series of openings forming a honeycomb patterns, etc.).

Figure 1C:
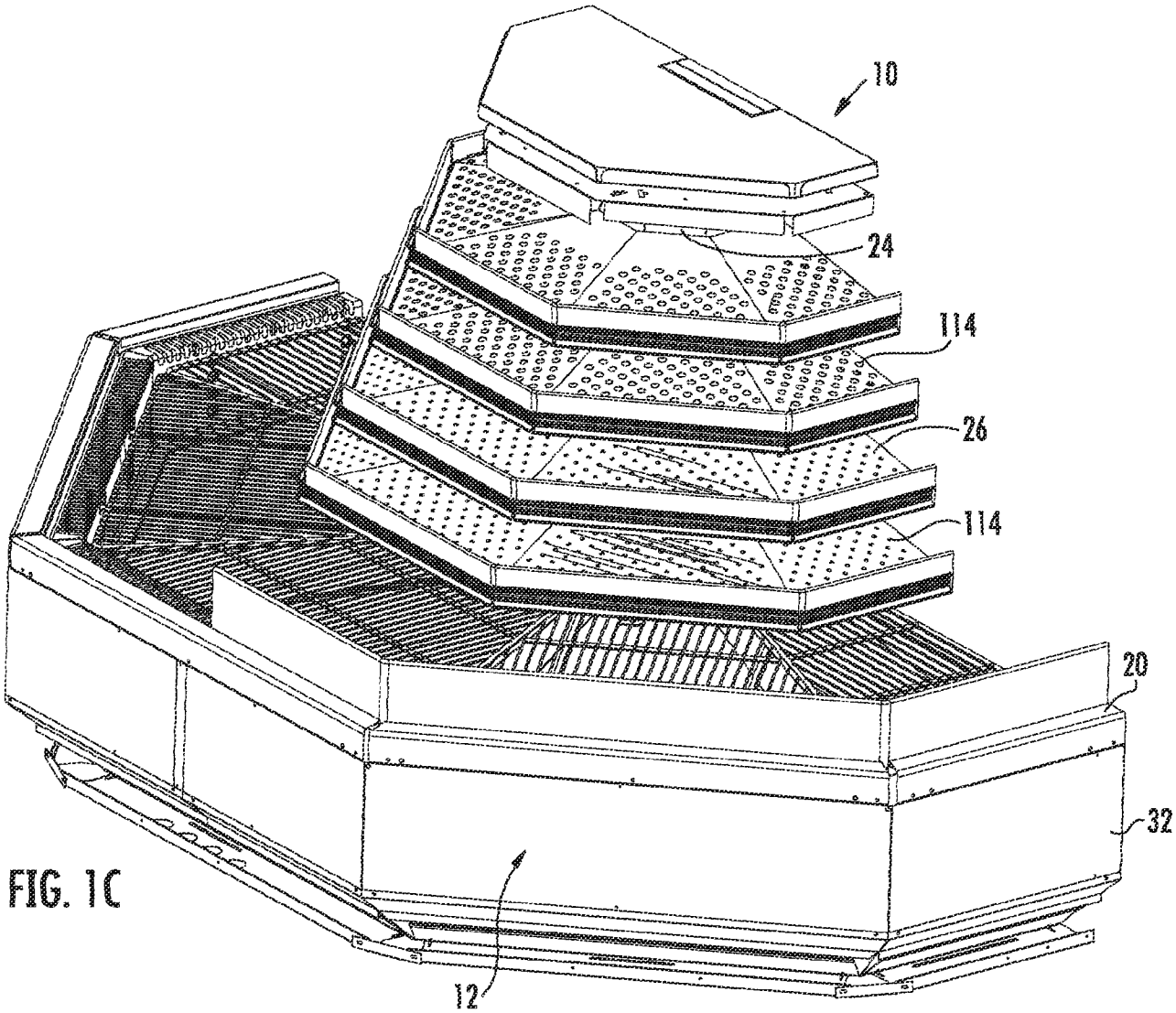
FIG. 1C is a perspective view of a temperature-controlled case according to a second exemplary embodiment.

Referring to FIG. 1C, a refrigerated case 10 is shown according to a second exemplary embodiment including four shelves 26 each having a plurality of shelf cover openings 114. Shelf cover openings 114 are shown getting progressively larger the higher the shelf is disposed relative to tower 24 (e.g., the closer to the top of the tower) in order to achieve a desired air flow and/or air flow velocity. The two shelves proximate the deck are shown having shelf cover openings that are smaller than the shelf cover openings of the two shelves thereabove (e.g., that are distal to the deck). Shelves 26 are further shown with shelf cover openings 114 being substantially circular and forming a pattern. Shelf cover openings 114 may form a first pattern on one shelf and a second pattern on a shelf thereabove. The first pattern and the second pattern may be the same. Alternatively, the first pattern and the second pattern may differ. In another embodiment, the openings in the shelf cover of each shelf may be the same size, but may become progressively more numerous the higher the shelf is disposed relative to the tower. In some embodiments, the openings in the shelf covers of a plurality of shelves increase in both size and number the higher each shelf is disposed relative to the tower. In some embodiments, the size and/or number of the openings becomes progressively larger and/or more numerous at each shelf. In some embodiments, the size and/or number of the openings get progressively larger every two, three, or more shelves. For example, in a lower grouping of two shelves, each shelf may have openings in the same size and/or number and/or pattern, and in an upper grouping of three shelves, each shelf may have openings in the same size and/or number and/or pattern; the size and/or number and/or pattern of the openings in the shelves of the lower grouping differ from the openings in the shelves of the upper grouping.

Referring back to FIGS. 2 and 5, air distribution system 28 is configured to balance the air flow to the front and the rear of each shelf 26 to maintain the products stored thereon at a more uniform temperature. Each shelf 26 is disposed relative to tower 24 such that at least some openings 80 are located above each shelf cover 112 and some openings 80 are located between each shelf cover 112 and shelf base 110 pairing. Openings 80 above each shelf cover 112 distribute sub-portions of first air flow portion 58 above and generally along each shelf cover 112. These sub-portions are primarily directed at rear portions 108 of shelves 26. Openings 80 between each shelf cover 112 and corresponding shelf base 110 distribute sub-portions of the first air flow portion 58 into spaces 116 therebetween. The sub-portions of first air flow portion 58 received in spaces 116 are distributed through openings 114. As openings 114 are disposed toward front portions 126 of shelf covers 112, the sub-portions of first air flow portion 58 received in spaces 116 are primarily directed at the front portions 106 of shelves 26. Spaces 114 may be configured to achieve a desired velocity of the sub-portions of first air flow portion 58 flowing through openings 114 (e.g., the spaces may have a cross section that generally decreases moving from the rear portion toward the front portion of each shelf, such as the wedge shaped space discussed above, etc.). In alternative embodiments, the shelf cover openings may be located on shelf so that the air is directed to products supported at other locations on the shelf. In other embodiments, shelf cover and shelf base may be integrally formed in any manner wherein a space is defined therebetween, or the shelves may not include shelf covers.

In one embodiment, shelves 26 are further configured to correspond to a faceted tower. As shown in FIG. 5, each shelf 26 includes a plurality of substantially planar segments corresponding to planar segments 86 and to channels 90 of tower 24. The air in each channel 90 is directed through the corresponding planar segment 86 of exterior wall 78 of tower 24 toward the corresponding segment of each shelf 26. In other embodiments, a plurality of shelves defining independent shelf segments may correspond to the planar segments of the tower.

Canopy 128 is shown located at top 74 of tower 24. As discussed above, canopy 128 may act as a flow restriction which creates back pressure and facilitates the discharge of sub-portions of the first air flow portion 58 through openings 80 in the exterior wall 78 of tower 24. Canopy 128 is also configured to receive the remaining portion of first air flow portion 58 in cavity 82 proximate top 74 of tower 24 (e.g., that part of the first air flow portion that has not yet been directed through exterior wall 78). Canopy 128 is then discharges and directs the remaining portion of first air flow portion 58 toward outer wall 32. To reach the outer wall 32 of base 20 the air is generally directed outward and downward (e.g., away from the tower and towards the ground/floor), establishing air curtain 70 (see, e.g., FIG. 2 illustrating air curtain). Air curtain 70 is configured to help maintain the temperature of the products in refrigerated case 10. Referring to FIG. 2, air curtain 70 is shown flowing downwardly over front 12 of refrigerated case 10. Air curtain 70 is intended to enhance the performance of refrigerated case 10 by providing a boundary or separation between the refrigerated interior or product space of refrigerated case 10 and the warmer ambient environment external to the case.

Air curtain 70 is received in an air return 130 as it approaches base 20. Referring back to FIG. 4, air return 130 is shown extending about the periphery of base 20 within outer wall 32 and proximate front portion 40 of deck 36. Air return 130 is configured to draw in air curtain 70. Air return 130 includes a body 132 and a plurality of openings shown as slots 134. Slots 134 are shown spaced apart generally about a top portion 136 of air return 130. Air curtain 70 is drawn in through slots 134 by fan 46 and flows through body 132 of air return 130. Fan 46 then directs return air flow portion 72 from air return 130 over cooling coil 48 of cooling system 22 to be cooled and recirculated.

Referring back to FIG. 2, air distribution system 28 is illustrated according to an exemplary embodiment including one or more ducts 84 and one or more air diverting devices such as scoops 138 (e.g, elbows, joints, etc.). Air distribution system 28 is configured to provide for enhanced air flow throughout refrigerated case 10. Air distribution system is further configured to provide for balanced cooling throughout refrigerated case 10 to help maintain products displayed therein at a substantially uniform temperature (e.g., preventing temperature disparities between products proximate the deck and products on the shelves, preventing temperature disparities between products supported on the front portion of each shelf and products and the rear portion of each shelf, etc.).

Referring to FIG. 5, duct 84 is configured to receive first air flow portion 58 of air flow 54 from cooling system 22 and direct first air flow portion 58 into tower 24. Duct 84 at least in part defines a passage between cavity 38, wherein cooling system 22 is housed, and cavity 82 of tower 24. Duct 84 is shown is proximate bottom 76 of tower 24 and extending generally about the perimeter of tower 24. Duct 84 is further shown including a duct front 140 having a duct opening 142 and a duct back 144. Duct opening 142 is located within cavity 38 wherein duct 84 receives first air flow portion 58 from air outlet 52 of cooling system 22. Duct back 144 is configured to guide first air flow portion 58 such that it substantially changes direction (e.g., from substantially parallel to bottom 30 of base 20 to substantially vertical). In some embodiments, the duct may be coupled to or integrally formed with the tower. In other embodiments, the duct may be a sheet-like element that is bent or formed to guide the first air flow portion into the tower. According to still other embodiments, the duct may be any feature or device configured to receive and direct the first air flow portion into the tower. The duct is typically formed of sheet metal, though, it may be made of other suitable materials, such as molded plastic, etc.

Figure 6:
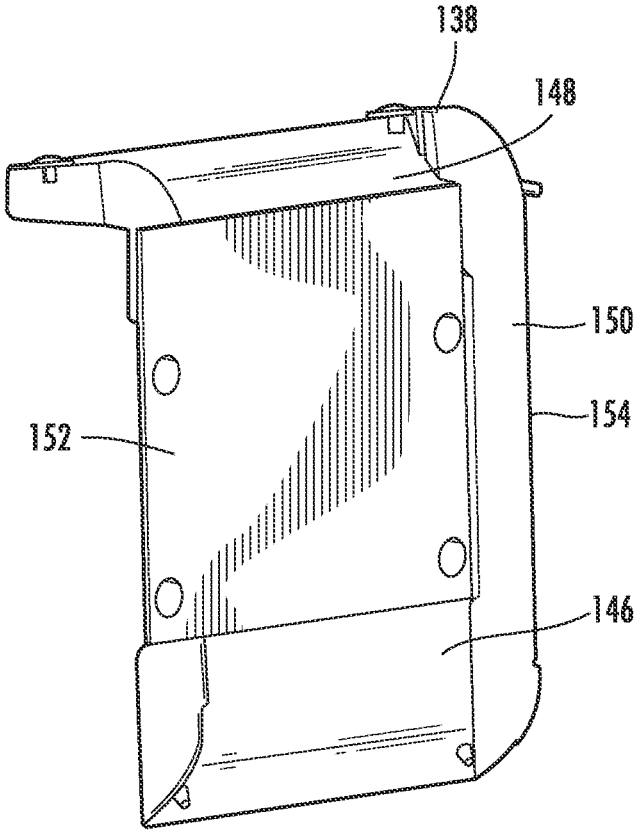
FIG. 6 is a perspective view of a scoop of the exemplary embodiment of a temperature-controlled case of FIG. 1A.

Referring to FIGS. 5 and 6, each scoop 138 includes a first opening or a scoop air inlet 146, a second opening or a scoop air outlet 148, a scoop body 150 extending therebetween, a scoop front side 152 and a scoop rear side 154. Scoops 138 are configured to receive (e.g., intercept, accept, catch, etc.) and direct (e.g., redirect, divert, etc.) second air flow portion 60 toward deck 36. Scoops 138 are further configured to permit first air flow portion 58 to be directed into tower 24. Scoops 138 are further configured to provide for distribution of the second air flow portion 60 along substantially the entire deck 36 (e.g., substantially all 180 degrees) in the embodiment shown. Second air flow portion 60 generally flows from a location proximate tower 24 toward outer wall 32 of base 20. Proximate front portion 40 of deck 36, second air flow portion 60 is drawn into air return 130 by fan 46.

Figure 7:
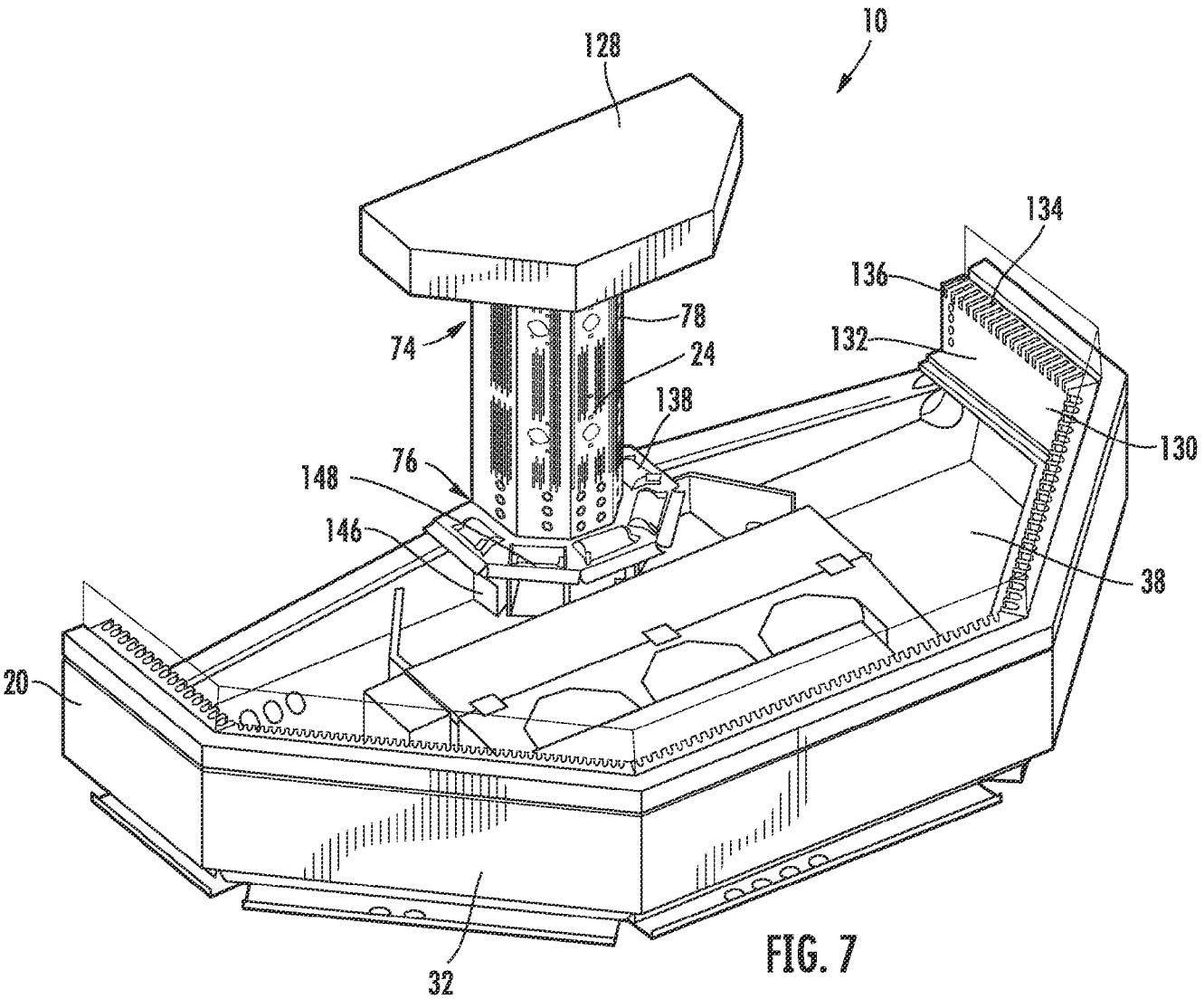
FIG. 7 is a perspective view of the exemplary embodiment of a temperature-controlled case of FIG. 1A with the shelves, the grate, and the deck removed.

Referring to FIG. 7, scoops 138 are shown positioned about the periphery of tower 24 proximate bottom 76. Referring back to FIG. 5, scoop air inlets 146 are located in cavity 38 below deck 36 and positioned to receive second air flow portion 60 from air outlet 52 of cooling system 22 without preventing receipt of first air flow portion 58 by duct 84. Scoop air outlets 142 are positioned in front of exterior wall 78 of tower 24 and above deck 36 to discharge second air flow portion therealong. Each scoop body 150 extends through deck 36 and defines a passage 156 (e.g., channel, conduit, etc.) that extends generally between scoop air inlet 146 and scoop air outlet 148. Scoop rears 154 are shown curved between the bottoms of scoop air inlets 146 and the tops of scoop air outlets 148, providing for an at least partially curved and smooth flow path for second air flow portion 60 flowing between scoop air inlets 146 and scoop air outlet 148. Scoop air inlets 146 are shown larger than scoop air outlets 148 to provide a desired air flow velocity at scoop air outlet 148. According to other embodiments, the scoop air inlet and the scoop air outlet may be the same size, the scoop air outlet may be larger than the scoop air inlet, and/or there may be multiple scoop air inlets and/or scoop air outlets for a given scoop. While scoop body 150 is shown including three pieces, the scoop body may be integrally formed or include a number of pieces (i.e., components, members, etc.) other than three according to other embodiments. According to another embodiment, a single scoop is provided. According to other embodiments, the scoops may be configured in any manner providing for receipt and direction of a second air flow portion and providing for first air flow portion to be received in the tower.

More generally, the scoops may receive portions of an air flow in one space or cavity and direct air flow portion to a second, different space or cavity. Further, the scoops typically cause an air flow to change direction (e.g., change an air flow path) in order to reach the second cavity or be discharged in a desired direction into the second cavity. Typically, the first space or cavity is separated from the second space or cavity. Accordingly, the scoop air outlet is typically to be located in a space or cavity other than the cavity in which the scoop air inlet is located.

Referring back to FIG. 2, the operation of air distribution system 28 is shown according to an exemplary embodiment. Air distribution system 28 provides for direction of first air flow portion 58 into tower 24. Air distribution system 28 further provides for direction of second air flow portion 60 toward deck 36. Air distribution system 28 further provides for sub-portions of first air flow portion 58 directed into tower 24 to be directed toward the front portion 106 and toward the rear portion 108 of each shelf 26. In this manner, air distribution system 28 provides for enhanced air flow, provides for balanced cooling of products displayed in refrigerated case 10, and substantially maintains the products displayed in refrigerated case 10 at a uniform temperature.

Air flow 54 is discharged from air outlet 52 of cooling system 22. Scoop air inlets 146 and duct opening 142 are positioned relative to each other such that portions of discharge air flow portion 56 of air flow 54 are received by both. While scoops 138 are shown proximate duct 84, scoop air inlets 146 are at least in part above duct opening 142 such that scoops 138 permit first air flow portion 58 to be received by duct 82 and directed into tower 24. Second air flow portion 60 is received in scoop air inlets 146 and directed toward deck 36.

Duct 84 directs first air flow portion 58 into cavity 82 of tower 24. Within cavity 82, first air flow portion 58 is distributed amongst channels 90 corresponding to planar segments 86 of exterior wall 78. When first air flow portion 58 encounters first diffuser 98, first diffuser 98 at least partially directs first air flow sub-portion 62 through openings 80 in exterior wall 78, into space 116 of first shelf 102, and toward front portion 106 of first shelf 102 (e.g., defines a first flow path). The openings in exterior wall 78 through which first air flow sub-portion 62 flows are generally disposed to correspond to the space between shelf cover 112 and shelf base 110 at rear portion 108 of first shelf 102. After flowing through openings 80 into space 116 of first shelf 102, first air flow sub-portion 62 flows toward front portion 106 of first shelf 102 and is distributed through openings 114. Openings 114 are generally disposed at front portion 126 of shelf cover 112 of first shelf 102. Accordingly, first air flow sub-portion 62 flowing through openings 114 provides for cooling of products supported at front portion 106 of first shelf 102.

Second diffuser 100 at least partially directs second air flow sub-portion 64 through openings 80 of exterior wall 78 generally above shelf cover 112 of second shelf 104 toward front portion 106 of first shelf 102 (e.g., defines a second flow path). Second diffuser 100 acts as a flow restriction and generates back pressure within cavity 82, thus directing or forcing second air flow sub-portion 64 from cavity 82 through openings 80 in exterior wall 78. Second air flow sub-portion 64 flows generally above shelf cover 112 of first shelf 102, primarily providing for cooling of products supported at rear portion 108 of first shelf 102. In this manner, air distribution system 28 provides for balanced cooling of products at the front and the rear of the first shelf, helping maintain all products supported on the first shelf at a substantially uniform temperature. Generally, the air distributed from channels 90 is distributed through openings 80 in a corresponding planar segment 86 of exterior wall 78 and then toward a corresponding segment or portion of first shelf 102.

First air flow portion 58 continues through cavity 82 of tower 24 until encountering second diffuser 100. Second diffuser 100 at least partially directs third air flow sub-portion 66 through openings 80 in exterior wall 78, through space 116 of second shelf 104, and toward front portion 106 of second shelf 104 (e.g., defines a third flow path). The openings in exterior wall 78 through which third air flow sub-portion 66 flows are generally disposed to correspond to the space between shelf cover 112 and shelf base 110 at rear portion 108 of second shelf 104. After flowing through openings 80 into space 116 of second shelf 104, third air flow sub-portion 66 flows toward front portion 106 of second shelf 104 and is distributed through openings 114. Openings 114 are generally disposed at front portion 126 of shelf cover 112 of second shelf 104. Accordingly, third air flow sub-portion 66 flowing through openings 114 provides for cooling of products supported at front portion 106 of second shelf 104.

Canopy 128 at least partially directs fourth air flow sub-portion 68 through openings 80 in exterior wall 78 generally above shelf cover 112 of second shelf 104 toward rear portion 108 of second shelf 104 (e.g., defines a fourth flow path). Canopy 128 may act as a flow restriction and generate back pressure within cavity 82, directing or forcing fourth air flow sub-portion 68 from cavity 82 through openings 80 in exterior wall 78. Fourth air flow sub-portion 68 flows through openings 80 of exterior wall 78 and continues to flow generally above shelf cover 112 of second shelf 104, primarily providing for cooling of products supported at rear portion 108 of second shelf 104. In this manner, air distribution system 28 provides for balanced cooling of products at the front and the rear of the second shelf, helping maintain all products supported on the second shelf at a substantially uniform temperature. Generally, the air distributed from channels 90 is distributed through openings 80 in a corresponding planar segment 86 of exterior wall 78 and then toward a corresponding segment or portion of second shelf 104.

In one embodiment, the shelf cover openings at the front portion of one or more shelves are sized and shaped in relation to the size and shape of the shelf cover openings of the other shelves in the refrigerated case in order to provide for a desired distribution of air flow. For example, the shelf cover openings in the shelf cover of second shelf may be larger than the shelf cover openings in first shelf. This may help ensure that air is distributed from the shelf cover openings of the second shelf with sufficient air flow velocity, as the velocity of the first air flow portion generally decreases as it travels upward in the tower and is dispersed therefrom. In this manner, potential temperature disparities between products supported on lower shelves and products supported on higher shelves may be avoided.

The air flow remaining in cavity 82 above the highest shelf of the plurality of shelves 26 (here, second shelf 104) is received in canopy 128. Canopy 128 directs the remaining air outward and downward toward outer wall 32 of base 20, forming air curtain 70. As discussed above, air curtain 70 enhances the performance of refrigerated case 10 by providing a boundary or separation between the refrigerated interior or product space of refrigerated case 10 and the warmer ambient environment external to the case. As air curtain 70 approaches outer wall 32 of base 20 it is drawn into air return 130. Air return 130 in turn directs this air as at least part of return air flow portion 72 toward cooling system 22 where it is cooled and recirculated.

Scoops 138 receive and direct second air flow portion 60 toward deck 36. As shown in FIG. 2, scoop air inlets 146 and scoop air outlets 142 are both at scoop front 152, such that air exits scoop air outlet 148 in a direction substantially opposite that at which it enters scoop air inlet 146. Second air flow portion 60, having been received in scoop air inlets 146, flows through passages 156 defined by scoop bodies 150. Passages 156 at least partially define a substantially curved air flow path. Second air flow portion 60 is dispersed through scoop air outlets 142, which are positioned generally above deck 36. The bottom of each scoop air outlet 148 is shown positioned approximately flush with deck 36, but, alternatively, may be spaced a distance thereabove. Scoop air outlets 148 are further shown angled to provide for direction of second air flow portion 60 at an angle substantially corresponding to the angle or grade of deck 36 in order to maintain the flow in relatively close proximity to deck 36. As shown in FIG. 2, when discharged from scoop air outlets 142, second air flow portion 60 flows generally along deck 36 outward from a location proximate tower 24 toward outer wall 32 of base 20. Second air flow portion 60 flows along deck 36 toward outer wall 32 until drawn into air return 130 proximate front portion 40 of deck 36 by fan 48. Air return 130 in turn directs this air in the form of at least part of return air flow portion 72 toward cooling system 22 where it is cooled and recirculated. In this manner, products on the deck 36 or above the deck on grate 44 are kept cool.

In this way, air distribution system provides for enhanced air flow 54 throughout refrigerated case 10. The products displayed in refrigerated case 10 are provided balanced cooling (e.g., cooled air is directed at the front and back of each shelf, etc.). Further, the products displayed in refrigerated case 10 are maintained at a substantially uniform temperature.

According to any preferred embodiment, an end portion of an island-style refrigerated case is provided with a base having a deck and a tower having a cavity. An air flow device is configured to provide an air flow which is dispersed through the refrigerated case by an air distribution system. The air distribution system includes one or more air diverting devices. The one or more air diverting devices permit a first portion of the air flow to be directed into and received in the cavity of the tower. The air is generally directed from the tower through a plurality of openings in an exterior wall of the tower. The one or more air diverting devices receive and direct a second portion of the air flow toward or along the deck of the base.

According to another preferred embodiments, the tower of the refrigerated case is a faceted structure having an exterior wall defining a cavity. The exterior wall includes a plurality of substantially planar segments. The cavity is segmented into channels that substantially correspond to the substantially planar segments of the exterior wall. A plurality of diffusers are disposed within the cavity of the tower to act as flow restrictions and direct air through the plurality of openings in the exterior wall of the tower. The diffusers include holes allowing some air to pass therethrough. The openings in the exterior wall are in a pattern and sized to achieve a desired air flow and air flow velocity. One or more shelves are disposed, coupled or otherwise attached to the tower at locations where air directed from the cavity of the tower flows toward the shelves. The shelves are also segmented to substantially correspond to the substantially planar segments of the exterior wall of the tower.

According to another preferred embodiments, the shelves of the refrigerated air case each include a front portion and a rear portion. The rear portion of each shelf is coupled, attached, or otherwise disposed proximate the faceted structure. Each shelf further includes a shelf base, a shelf cover, and a space defined therebetween. The space is substantially wedge-shaped. Each shelf cover includes a plurality of openings in a pattern at a front portion of the shelf cover. The openings are substantially circular holes, and the openings increase in size and/or number at shelves closer to the top of the faceted structure. Air directed through a plurality of openings in the faceted structure is directed at the shelves. Sub-portions of the air are directed through the space, out the openings in the shelf cover, and toward the front portion of the shelf. Other sub-portions of the air are directed through from the cavity toward the rear portion of each shelf.

As utilized herein, the terms "approximately," "about," "substantially," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members, or the two members and any additional intermediate members, being integrally formed as a single unitary body with one another, or with the two members, or the two members and any additional intermediate members, being attached to one another.

It should be noted that the orientation of various elements may differ according to other exemplary embodiments, and that such variations are intended to be encompassed by the present disclosure (e.g., the scoops relative to the tower, the air flow relative to the deck, etc.).

It is also important to note that the construction and arrangement of the refrigerated case as shown in the various exemplary embodiments is illustrative only. Although only a few embodiments of the present inventions have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter disclosed herein. For example, elements shown as integrally formed may be constructed of multiple parts or elements, the position of elements may be reversed or otherwise varied, and the nature or number of discrete elements or positions may be altered or varied. Accordingly, all such modifications are intended to be included within the scope of the present invention as defined in the appended claims. The order or sequence of any process or method steps may be varied or re-sequenced according to alternative embodiments. Other substitutions, modifications, changes and omissions may be made in the design, operating conditions and arrangement of the various exemplary embodiments without departing from the scope of the present inventions.

What is claimed is:

1. A temperature-controlled case, comprising:

a base including a deck and an air flow device located below the deck and configured to provide an air flow;

an air distribution tower comprising a vertical exterior wall defining a cavity;

a plurality of shelves each having a front portion and a rear portion, the rear portion of each shelf disposed adjacent to the air distribution tower;

at least one of the plurality of shelves including a shelf base, a shelf cover, and a space defined therebetween, the shelf cover including a plurality of openings at the front portion of the at least one shelf;

a first set of openings in the vertical exterior wall between the shelf base and the shelf cover, the first set of openings providing a first flow path from the cavity, into the space between the shelf base and the shelf cover, and through the plurality of openings at the front portion of the at least one shelf;

a second set of openings in the vertical exterior wall between the plurality of shelves, the second set of openings providing a second flow path from the cavity to the rear portion of the at least one shelf without passing through any of the plurality of shelves; and an air diverting device disposed adjacent to the vertical exterior wall and comprising a first opening below the deck, a second opening above the deck, and a body defining a passage through the deck between the first opening and the second opening, wherein the air diverting device receives a second portion of the air flow at the first opening below the deck, directs the second portion of the air flow through the passage from the first opening to the second opening, and outputs the second portion of the airflow perpendicularly outward from the vertical exterior wall at the second opening above the deck.

2. The temperature-controlled case of claim 1, wherein the air distribution tower includes a first diffuser that at least partially defines the first flow path of the air flow toward the front portion of the at least one shelf and a second diffuser that at least partially defines the second flow path of the air flow toward the rear portion of the at least one shelf.

3. The temperature-controlled case of claim 1, wherein the shelf base and the shelf cover define a wedge shaped space therebetween.

4. The temperature-controlled case of claim 1, wherein the plurality of openings comprise circular holes arranged in a pattern and disposed toward the front portion of the at least one shelf.

5. The temperature-controlled case of claim 1, wherein the plurality of shelves includes a first shelf comprising openings arranged in a first pattern and a second shelf comprising openings arranged in a second pattern, the second shelf being above the first shelf and the openings of the second pattern being generally larger than the openings of the first pattern.

6. The temperature-controlled case of claim 1, wherein the plurality of shelves includes a first shelf comprising openings arranged in a first pattern and a second shelf comprising openings arranged in a second pattern, the second shelf being above the first shelf and the second pattern comprising more openings than the first pattern.

7. The temperature-controlled case of claim 1, wherein the air distribution tower includes the vertical exterior wall having a plurality of substantially planar segments.

8. The temperature-controlled case of claim 7, wherein at least one shelf includes a plurality of substantially planar segments corresponding to the plurality of substantially planar segments of the exterior wall of the air distribution tower.

9. The temperature-controlled case of claim 7, wherein the air distribution tower includes the cavity segmented into a plurality of channels extending substantially vertically and corresponding to the plurality of substantially planar segments of the exterior wall of the air distribution tower.

10. A temperature-controlled case, comprising:

a base including a deck providing an upper surface of a cavity below the deck;

an air flow device located within the cavity below the deck and configured to provide an air flow, the air flow having a first portion and a second portion;

an air distribution tower having a perimeter with a portion defined by a polygonal shape having a plurality of substantially planar wall segments;

a plurality of shelves each having a front portion and a rear portion, the rear portion of each shelf disposed adjacent to the air distribution tower;

a plurality of air diverting devices, wherein each air diverting device is disposed adjacent to one of the planar wall segments and comprises a first opening below the deck, a second opening above the deck, and a body defining a passage through the deck between the first opening and the second opening, wherein each air diverting device receives the second portion of the air flow at the first opening below the deck, directs the second portion of the air flow through the passage from the first opening to the second opening, and outputs the second portion of the airflow perpendicularly outward from the adjacent planar wall segment at the second opening above the deck; and wherein each air diverting device permits the first portion of the air flow to be directed into the air distribution tower.

11. The temperature-controlled case of claim 10, further comprising a duct configured to receive the first portion of the air flow and direct the first portion of the air flow into the air distribution tower.

12. The temperature-controlled case of claim 10, wherein the air diverting device is configured to receive the second portion of the air flow having a first flow direction at the first opening, to direct the second portion of the air flow through the deck of the base, and to output the second portion of the airflow having a second flow direction at the second opening, wherein the second flow direction is opposite the first flow direction.

13. The temperature-controlled case of claim 10, further comprising an air return disposed proximate a front portion of the deck, wherein the second portion of the air flow is at least partially drawn into the air return by the air flow device.

14. The temperature-controlled case of claim 10, wherein the air diverting device comprises one or more scoops, each scoop including the body extending through the deck of the base, the first opening below the deck, and the second opening above the deck.

15. The temperature-controlled case of claim 14, the passage at least partially defining a curved air flow path.

16. The temperature-controlled case of claim 15, wherein the first opening is larger than the second opening.

17. A temperature-controlled case, comprising:

a base including a deck;

an air flow device located below the deck and configured to provide an air flow;

a faceted air distribution tower including a substantially vertical exterior wall, the exterior wall defined at least partially by a plurality of vertical planar segments and defining a cavity, the cavity being segmented by at least one interior wall that extends vertically upward from a bottom of the air distribution tower to a top of the air distribution tower and that separates the cavity into a plurality of separate and adjacent substantially vertical channels, wherein each of the plurality of channels substantially corresponds to one of the plurality of planar segments of the exterior wall and directs the air flow upward from the bottom of the air distribution tower along a corresponding planar segment of the exterior wall, wherein each of the plurality of vertical planar segments of the vertical exterior wall and each of the plurality of vertical channels within the cavity extends from the bottom of the air distribution tower to the top of the air distribution tower;

a plurality of shelves having a front portion and a rear portion, the rear portion of each shelf disposed proximate the air distribution tower;

a plurality of diffusers positioned in the air distribution tower, each of the plurality of diffusers configured to at least partially define one or more flow paths for the air flow from the plurality of channels toward at least one of the plurality of shelves; and an air diverting device disposed adjacent to the vertical exterior wall and comprising a first opening below the deck, a second opening above the deck, and a body defining a passage through the deck between the first opening and the second opening, wherein the air diverting device receives a second portion of the air flow at the first opening below the deck, directs the second portion of the air flow through the passage from the first opening to the second opening, and outputs the second portion of the airflow perpendicularly outward from the vertical exterior wall at the second opening above the deck.

18. The temperature-controlled case of claim 17, wherein one of the plurality of diffusers at least partially defines a first flow path extending through a space within one of the plurality of shelves and toward the front portion of the shelf.

19. The temperature-controlled case of claim 17, wherein each of the plurality of shelves includes a shelf base, a shelf cover, and a space defined between the shelf cover and the shelf base, the plurality of diffusers configured to direct air from the plurality of channels toward the front portions of the plurality of shelves through a plurality of openings in each shelf cover.

20. The temperature-controlled case of claim 17, wherein the air diverting device is configured to receive the second portion of the air flow and direct the second portion of the air flow toward the deck of the base.

21. The temperature-controlled case of claim 17, wherein the air diverting device directs a first portion of the air flow into the air distribution tower.

22. The temperature-controlled case of claim 17, wherein the air diverting device comprises a scoop, the scoop including the body extending through the deck of the base, the first opening below the deck, the second opening above the deck, and the passage extending between the first opening and the second opening, the passage at least partially defining a curved air flow path.

* * * * *